US007612741B2

(12) United States Patent
Kim

(10) Patent No.: US 7,612,741 B2
(45) Date of Patent: Nov. 3, 2009

(54) PLASMA DISPLAY DEVICE AND DRIVING METHOD THEREOF

(75) Inventor: Dae-Hwan Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 691 days.

(21) Appl. No.: 11/272,088

(22) Filed: Nov. 14, 2005

(65) Prior Publication Data

US 2006/0103601 A1 May 18, 2006

(30) Foreign Application Priority Data

Nov. 15, 2004 (KR) ..... 10-2004-0093066

(51) Int. Cl.
*G09G 3/28* (2006.01)
*G09G 3/10* (2006.01)
*G09G 5/10* (2006.01)

(52) U.S. Cl. ..... 345/67; 345/37; 345/60; 345/62; 345/63; 345/204; 345/692; 345/693; 315/169.4; 313/582

(58) Field of Classification Search ..... 345/55–100, 345/204–214, 690–697; 315/169.4
See application file for complete search history.

(56) References Cited

U.S. PATENT DOCUMENTS

| | | | | |
|---|---|---|---|---|
| 6,278,422 | B1 * | 8/2001 | Ukai et al. | 345/63 |
| 6,362,800 | B1 * | 3/2002 | Moon | 345/60 |
| 6,456,264 | B1 * | 9/2002 | Kang et al. | 345/63 |
| 6,597,331 | B1 * | 7/2003 | Kim | 345/60 |
| 6,731,255 | B1 * | 5/2004 | Van Leeuwen et al. | 345/60 |
| 2002/0018031 | A1 * | 2/2002 | Nakamura et al. | 345/60 |
| 2004/0100425 | A1 * | 5/2004 | Kang et al. | 345/68 |
| 2004/0212563 | A1 | 10/2004 | Kang et al. | |
| 2005/0122285 | A1 * | 6/2005 | Kang et al. | 345/60 |

FOREIGN PATENT DOCUMENTS

| | | |
|---|---|---|
| CN | 1412732 | 4/2003 |
| JP | 07-191627 | 7/1995 |
| JP | 08-340504 | 12/1996 |
| JP | 09-244578 | 9/1997 |
| JP | 2001-350446 | 12/2001 |
| JP | 2002-108281 | 4/2002 |
| JP | 2005-215670 | 8/2005 |
| KR | 1020010002395 A1 | 1/2001 |
| KR | 1020040046264 A1 | 6/2004 |

* cited by examiner

*Primary Examiner*—Bipin Shalwala
*Assistant Examiner*—Benyam Ketema
(74) *Attorney, Agent, or Firm*—H.C. Park & Associates, PLC

(57) ABSTRACT

When driving a plasma display panel, in a first subfield of a first frame, turn-on cells are selected among cells of a first group of electrodes by performing an address operation for the first group, and a sustain discharge is performed for selected cells, and turn-on cells are selected among cells of a second group of electrodes by performing an address operation for the second group, and a sustain discharge is performed for selected cells. In a first subfield of a second frame, turn-on cells are selected among cells of the second group by performing an address operation for the second group, and a sustain discharge is performed for selected cells, and turn-on cells are selected among cells of the first group by performing an address operation for the first group, and a sustain discharge is performed for selected cells.

27 Claims, 7 Drawing Sheets

FIG.2

| Subfield Number | | 1 | 2 | 3 | 4 | 5 | 6 | 7 | 8 |
|---|---|---|---|---|---|---|---|---|---|
| Grayscale / Electrodes | | 1 | 2 | 4 | 8 | 16 | 32 | 64 | 128 |
| G1 | $Y_{11}$ $Y_{12}$ ⋮ | | | | | | | | |
| G2 | $Y_{21}$ $Y_{22}$ ⋮ | | | | | | | | |
| ⋮ | ⋮ | | | | | | | | |
| Gn | $Y_{n1}$ $Y_{n2}$ ⋮ | | | | | | | | |

FIG.6

| Frame | First Frame | | | | | | | | Second Frame | | | | | | | |
|---|---|---|---|---|---|---|---|---|---|---|---|---|---|---|---|---|
| Subfield | SF1 | SF2 | SF3 | SF4 | SF5 | SF6 | SF7 | SF8 | SF1 | SF2 | SF3 | SF4 | SF5 | SF6 | SF7 | SF8 |
| Address Operation Order | Yeven | Yodd | Yeven | Yodd | Yeven | Yodd | Yeven | Yodd | Yodd | Yeven | Yodd | Yeven | Yodd | Yeven | Yodd | Yeven |
| | Yodd | Yeven | Yodd | Yeven | Yodd | Yeven | Yodd | Yeven | Yeven | Yodd | Yeven | Yodd | Yeven | Yodd | Yeven | Yodd |

PLASMA DISPLAY DEVICE AND DRIVING METHOD THEREOF

CROSS-REFERENCE TO RELATED APPLICATION

This application claims priority to and the benefit of Korean Patent Application No. 10-2004-0093066, filed on Nov. 15, 2004, which is hereby incorporated by reference for all purposes as if fully set forth herein.

BACKGROUND OF THE INVENTION

1. Field of the Invention

The present invention relates to a method for driving a plasma display panel and a plasma display device.

2. Discussion of the Background

A plasma display panel (PDP) is a flat panel display that uses plasma generated by gas discharge to display characters or images. It may include, depending on its size, millions of pixels arranged in a matrix pattern.

Generally, the PDP is driven by dividing one frame into a plurality of subfields having respective weights. Grayscales of a discharge cell in a PDP may be expressed by a combination of the respective weights of light-emitting subfields of the discharge cell. Each subfield may include a reset period, an address period, and a sustain period. The reset period is for initializing the status of each discharge cell. The address period is for performing an addressing operation to select turn-on/turn-off cells. The sustain period is for sustain discharging turned on cells to satisfy a weight value of the corresponding subfield, thereby displaying a picture.

In the address period, a scan pulse is sequentially applied to scan electrodes so that the addressing operation may be sequentially performed. As such, after completing the addressing operation for all cells, the sustain discharging operations are performed in the sustain period.

With such a driving method, the sustain discharging operation is not performed for the firstly addressed scan electrode until the addressing operation is performed for all scan electrodes. Consequently, in a previously addressed discharge cell, sustain discharging may occur after a relatively long time as compared to in another discharge cell.

In a discharge cell having a long idle time, priming particles and/or a wall voltage formed in the discharge cell by the addressing operation may be reduced. Hence, the sustain discharging operation may become unstable.

The above information disclosed in this Background section is only for enhancement of understanding of the background of the invention, and therefore it may contain information that does not form the prior art that is already known in this country to a person or ordinary skill in the art.

SUMMARY OF THE INVENTION

The present invention provides a method for driving a PDP, and a plasma display device, that may reduce discharge cell idle time between the address operation and the sustain discharge operation.

Additional features of the invention will be set forth in the description which follows, and in part will be apparent from the description, or may be learned by practice of the invention.

The present invention discloses a method for driving a plasma display panel having a plurality of first electrodes and a plurality of second electrodes, and a plurality of third electrodes formed crossing the first electrodes and the second electrodes, and a discharge cell is defined by the first, second, and third electrodes and one frame is divided into a plurality of subfields, the plurality of first electrodes are divided into a plurality of groups, and the subfields include a plurality of sustain periods and a plurality of address periods corresponding to the respective groups. In the method, in a first subfield of a first frame, turn-on discharge cells are selected among discharge cells of a first group of first electrodes by performing an address operation for the first group, and a sustain discharge is performed for selected cells, and turn-on discharge cells are selected among discharge cells of a second group of first electrodes by performing an address operation for the second group, and a sustain discharge is performed for selected discharge cells. In a first subfield of a second frame, turn-on discharge cells are selected among discharge cells of the second group by performing an address operation for the second group, and a sustain discharge is performed for selected discharge cells, and turn-on discharge cells are selected among discharge cells of the first group by performing an address operation for the first group, and a sustain discharge is performed for selected cells.

The present invention also discloses a plasma display device including a PDP having a plurality of first electrodes and a plurality of second electrodes, and a plurality of third electrodes formed crossing the first electrodes and the second electrodes, and a discharge cell is defined by the first, second, and third electrodes, and a driver for applying a driving signal to the first electrodes, which are divided into a plurality of groups. In a first subfield of a first frame including a plurality of sustain periods and a plurality of address periods corresponding to the respective groups of first electrodes, the driver selects turn-on discharge cells among discharge cells of a first group of first electrodes by performing an address operation for the first group, and performs a sustain discharge for selected discharge cells, and then selects turn-on discharge cells among discharge cells of a second group of first electrodes by performing an address operation for the second group, and performs a sustain discharge for selected cells. In a first subfield of a second frame including a plurality of sustain periods and a plurality of address periods corresponding to the respective groups of first electrodes, the driver selects turn-on discharge cells among discharge cells of the second group by performing an address operation for the second group, and performs a sustain discharge for selected discharge cells; and then selects turn-on discharge cells among discharge cells of the first group by performing an address operation for the first group, and performs a sustain discharge for selected cells.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

FIG. 2 is a block diagram showing a driving method for a PDP according to an exemplary embodiment of the present invention.

FIG. 6 is a block diagram showing a driving method for a PDP according to a third exemplary embodiment of the present invention.

DETAILED DESCRIPTION OF THE ILLUSTRATED EMBODIMENTS

Figure 1:
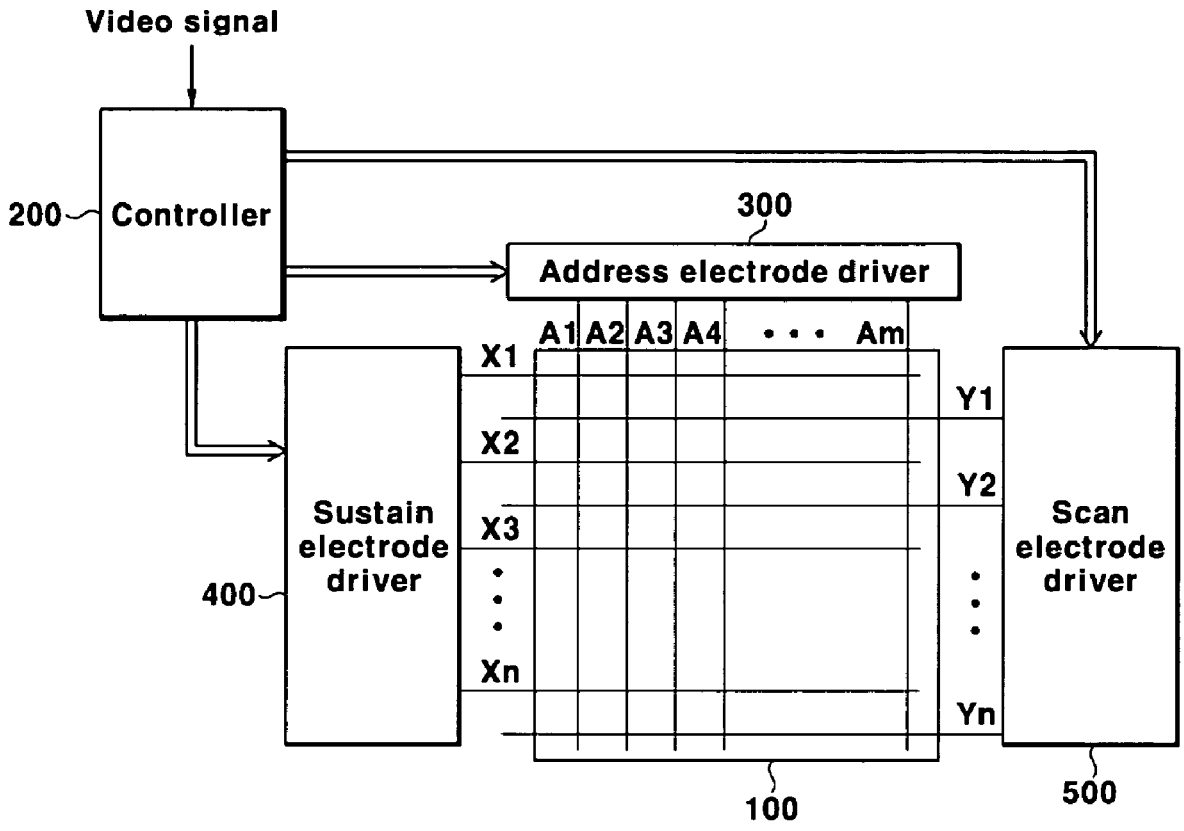
FIG. 1 is a schematic view of a plasma display device according to an exemplary embodiment of the present invention.

In the following detailed description, only certain exemplary embodiments of the present invention have been shown and described, simply by way of illustration. As those skilled in the art would realize, the described embodiments may be modified in various ways, all without departing from the spirit or scope of the present invention. Accordingly, the drawings and description are to be regarded as illustrative in nature and not restrictive. Like reference numerals designate like elements throughout the specification.

A plasma display device and an image processing method thereof according to an exemplary embodiment of the present invention will hereinafter be described in detail with reference to the accompanying drawings.

First, a plasma display device according to an exemplary embodiment of the present invention will hereinafter be described in detail with reference to FIG. 1, which is a schematic plan view of a plasma display device according to an exemplary embodiment of the present invention.

As shown in FIG. 1, a plasma display device may include a PDP 100, a controller 200, an address electrode driver 300, a sustain electrode driver (X electrode driver) 400, and a scan electrode driver (Y electrode driver) 500. The PDP 100 may include a plurality of address electrodes A1 to Am arranged in columns, and a plurality of scan electrodes Y1 to Yn and a plurality of sustain electrodes X1 to Xn alternately arranged in rows. The X electrodes X1 to Xn are formed corresponding to the Y electrodes Y1 to Y n, respectively. Discharge cells are formed by discharge spaces at regions where the address electrodes cross the scan and sustain electrodes.

The controller 200 receives video signals and outputs address electrode driving control signals, X electrode driving control signals, and Y electrode driving control signals. Also, the controller 200 may drive the PDP 100 by dividing a frame into a plurality of subfields, wherein a subfield may sequentially include a reset period, an address period, and a sustain period. The address driver 300 receives the address electrode driving control signals from the controller 200 and applies display data signals for selecting desired discharge cells to the address electrodes A1 to Am. The X electrode driver 400 receives the X electrode driving control signals from the controller 200 and applies driving voltages to the X electrodes X1 to Xn.

The Y electrode driver 500 receives the Y electrode driving control signals from the controller 200 and applies driving voltages to the Y electrodes Y1 to Yn.

Next, an image processing method according to an exemplary embodiment of the present invention will be described in detail with reference to FIG. 2, FIG. 3 and FIG. 4

FIG. 2 is a block diagram showing a driving method for a PDP in which scan electrode lines are divided into a plurality of groups (n number of groups) and one frame is divided into a plurality of subfields for the respective groups. Each group express grayscales by a combination of eight subfields.

The scan electrode lines are divided into a predetermined number of groups according to a physical arrangement order thereof. For example, when the panel includes 800 scan electrode lines divided into 8 groups, the first group may include the first to 100th scan electrode lines, and the second group may include the 101st to 200th scan electrode lines. When dividing the scan electrode lines into a plurality of groups, each group need not be formed of consecutive scan electrode lines. For example, each group may include scan electrode lines that are spaced apart by a predetermined interval. Hence, the first group may include the first, ninth, seventeenth, . . . and (8k+1)th scan electrode lines, and the second group may include the second, tenth, eighteenth, . . . and (8k+2)th scan electrode lines. Additionally, the groups may be randomly formed.

Figure 3:
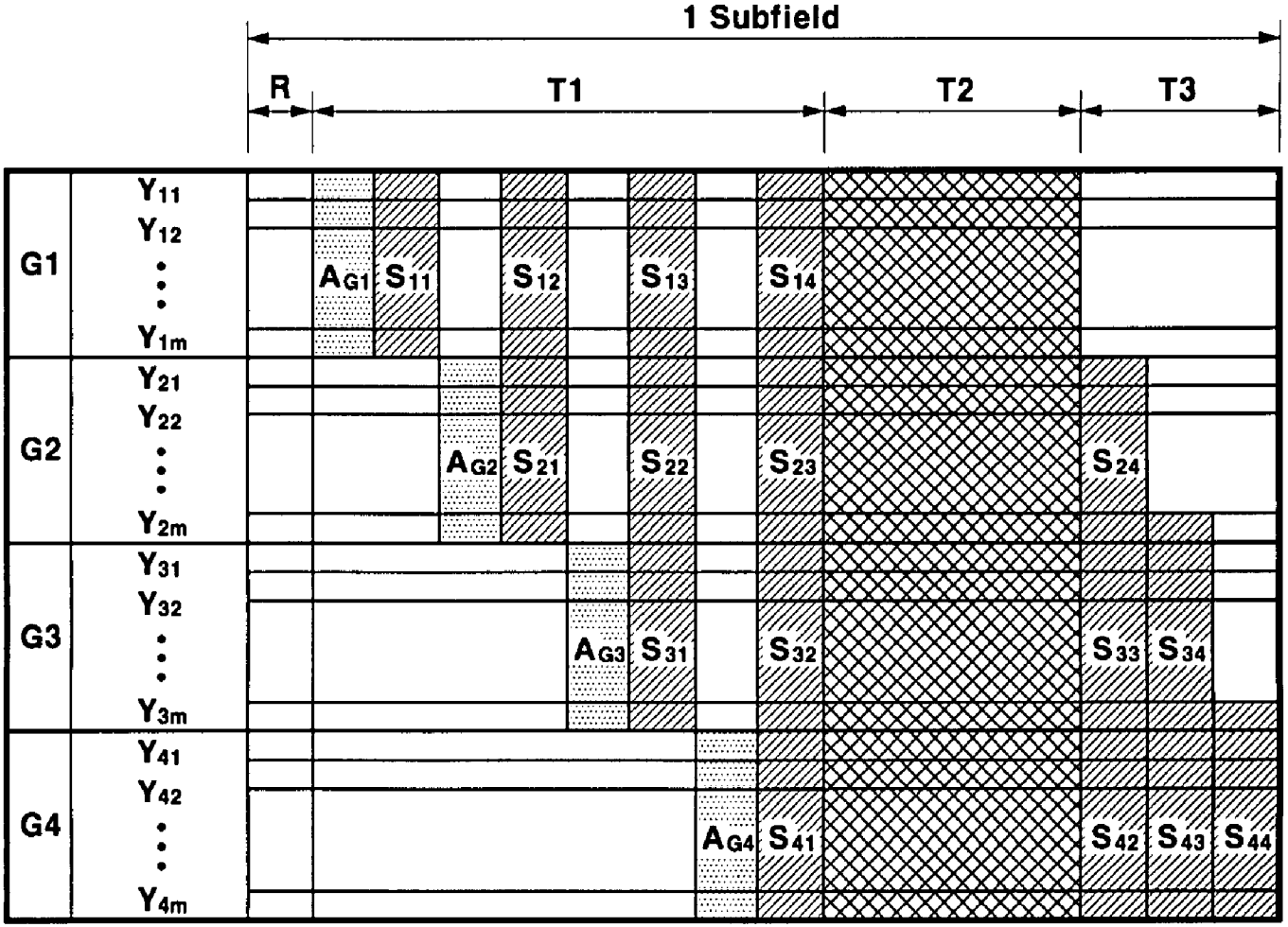
FIG. 3 is a block diagram showing an example in which scan electrode lines are divided into four groups in a PDP.

FIG. 3 is a block diagram showing an example in which scan electrode lines are divided into four groups in a PDP. One subfield may be expressed by a reset period R, an address/sustain combination period T1, a common sustain period T2 and a brightness correction period T3.

The reset period R is a period to initialize the wall charge state of each cell in the PDP by applying a reset pulse to all scan electrode line groups.

In the address/sustain combination period T1, an address operation $A_{G1}$ is sequentially performed from a first scan electrode line $Y_{11}$ to a last scan electrode line $Y_{1m}$ of a first group G1 of scan electrode lines. When the address operation $A_{G1}$ is completed for each cell of the first group G1, at least one sustain pulse may be applied to the scan electrode lines $Y_{11}$ to $Y_{1m}$ to perform a first sustain discharge operation $S_{11}$.

When the first sustain discharge operation $S_{11}$ ends for the first group G1, an address operation $A_{G2}$ is performed for each cell of a second group G2 of scan electrode lines.

When the address period $A_{G2}$ ends, that is, the address operation is completed for all scan electrode lines of the second group G2, a first sustain period $S_{21}$ is provided for the second group G2. In this case, a second sustain period $S_{12}$ is provided for the first group G1 for which the first sustain period $S_{11}$ has already been provided. When the desired grayscale has been expressed in the first sustain period $S_{11}$ of the first group G1, the second sustain period $S_{12}$ may not be provided for the first group G1. A pause state may be maintained for those cells for which an address period has not been provided.

When the first sustain period $S_{21}$ ends, an address period $A_{G3}$ and a first sustain period $S_{31}$ is provided for the third group G3 of scan electrode lines in the above-noted manner. In this case, while the first sustain period $S_{31}$ is provided for the third group G3, a second sustain period $S_{22}$ may be provided for cells of the second group G2 and a third sustain period $S_{13}$ may be provided for cells of the first group G1, for which previous sustain periods have already been provided. When the desired grayscale has been expressed by the second sustain period $S_{12}$ of the first group G1 and the first sustain period $S_{21}$ of the second group G2, the further sustain period $S_{13}$ and $S_{22}$ may not be provided.

Finally, when the first sustain period $S_{31}$ ends, an address period $A_{G4}$ and a first sustain period $S_{41}$ is provided for the fourth group G4 of scan electrode lines in the above-noted manner. In this case, while the first sustain period $S_{41}$ is provided for the fourth group G4, a second sustain period $S_{32}$ may be provided for cells of the third group G3, a third sustain period $S_{23}$ may be provided for cells of the second group G2, and a fourth sustain period $S_{14}$ may be provided for cells of the first group G1, for which previous sustain periods have already been provided.

Referring to FIG. 3, while one sustain period is provided for cells of one group of scan electrode lines, further sustain periods may be provided for cells for which previous sustain periods have already been provided. In this case, assuming that the same number of sustain pulses are applied, and that the same brightness is realized during a unit sustain period, the brightness of the first group G1 may be n times that of the nth group Gn. Likewise, the brightness of the second group G2 may be n-1 times that of the nth group Gn, and the brightness of the n-1th group Gn-1 may be 2 times that of the nth group Gn. Further sustain periods may be provided to correct such brightness differences of the respective groups. Accordingly, the brightness correction period $T_3$ may be provided.

The brightness correction period $T_3$ is designed to correct the respective groups' brightness difference such that cells have a uniform grayscale for the respective groups. To this end, sustain discharges are selectively provided for the respective groups in the brightness correction period $T_3$.

The common sustain period $T_2$ is a period in which a common sustain pulse is applied for all cells. Also, the common sustain period $T_2$ may be provided when the grayscale specification allocated for the respective subfields is not sufficiently expressed by the address/sustain combination period $T_1$ or the address/sustain combination period $T_1$ and the brightness correction period $T_3$. As shown in FIG. 3, the common sustain period $T_2$ may be provided after the address/sustain combination period $T_1$. Alternatively, the common sustain period $T_2$ may be provided after the brightness correction period $T_3$.

Furthermore, the common sustain period $T_2$ may be variably provided so as to have an appropriate size according to a weight value of a subfield.

Also, only in the address/sustain combination period $T_1$, one subfield may be realized. In summary, after completing the address operation and the sustain discharge operation for one group, the address operation and the sustain discharge operation are sequentially performed for other groups. That is, the address/sustain period may be sequentially provided from the first group G1 to the fourth group G4.

Figure 4:
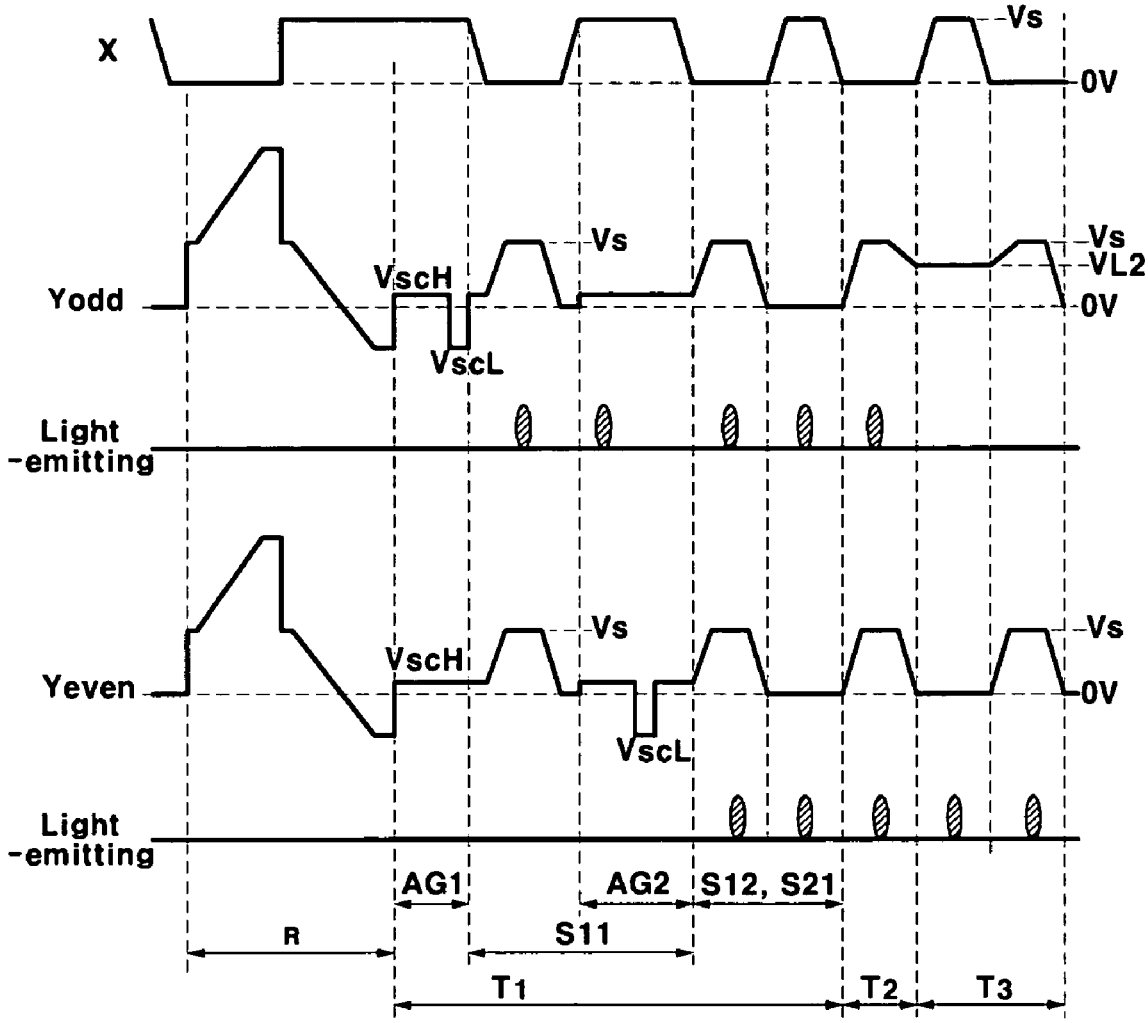
FIG. 4 is a driving waveform diagram of a plasma display device according to a first exemplary embodiment of the present invention.

FIG. 4 is a driving waveform diagram of a plasma display device according to a first exemplary embodiment of the present invention, wherein a driving method of FIG. 3 is applied to the scan electrodes, which are divided into an odd numbered line group Yodd and an even numbered line group Yeven, and the sustain electrodes X.

Referring to FIG. 4, the reset period R is designed to initialize the wall charge state of each cell by applying a reset waveform to the odd numbered line group Yodd and even numbered line group Yeven of the scan electrodes. FIG. 4 shows an example of a reset waveform that may be used to initialize the cells. Since it is a general waveform, a detailed description thereof is omitted.

In the address/sustain combination period $T_1$, an address period $A_{G1}$ and a sustain period $S_{11}$ are first provided for the odd numbered line group Yodd. When the sustain period $S_{11}$ ends, an address period $A_{G2}$ is provided for the even numbered line group Yeven. A second sustain period $S_{12}$ is then provided for the odd numbered line group Yodd, while a first sustain period $S_{21}$ is simultaneously provided for the even numbered line group Yeven. As FIG. 4 shows, the sustain period $S_{11}$ may overlap the address period $A_{G2}$. However, these two periods $S_{11}$ and $A_{G2}$ may alternatively be separate.

In the address period $A_{G1}$, a scan pulse, which has a voltage of VscL, is sequentially supplied to select the scan electrodes of the odd numbered line group Yodd while biasing the scan electrodes of the even numbered line group Yeven and the unselected scan electrodes of the odd numbered line group Yodd at a voltage of VscH. Though not shown, an address voltage is applied to the address electrodes so as to address (i.e. select, turn-on) desired cells among cells defined by the scan electrode line to which the scan pulse is applied.

Consequently, an address discharge is generated by the voltage difference of the address voltage and the voltage VscL, and a wall voltage formed by the wall charges on the address and scan electrodes, and accordingly, a wall voltage is formed between the scan and sustain electrodes.

In the sustain period $S_{11}$ of the address/sustain combination period $T_1$, a sustain pulse is alternately applied to the scan electrodes and the sustain electrodes X. Referring to FIG. 4, a sustain pulse is applied to the scan electrodes Yodd and Yeven and the sustain electrodes X. The sustain pulse may have a high level voltage (Vs voltage of FIG. 4) and a low level voltage (0V or VscH voltage of FIG. 4), and the voltage of Vs or Vs-VscH, along with the wall voltage, generates a sustain discharge. First, in the sustain period S11, when the voltage Vs is applied to the scan electrodes Yodd and Yeven and 0V is applied to the sustain electrodes X, a positive (or negative) wall voltage formed by the address discharge between the scan electrodes Yodd and the address electrodes together with a voltage difference Vs between the scan electrodes Yodd and the sustain electrodes X, generates a sustain discharge. As a result, the negative (or positive) wall voltage forms between the scan electrodes and the sustain electrodes X.

In the sustain period $S_{11}$ of the address/sustain combination period $T_1$, although the sustain pulse is applied to the scan electrodes of the even numbered line group Yeven, the wall voltage is not formed between the scan electrodes Yeven and the sustain electrodes X. Hence, the sustain discharge is not generated between the scan electrodes Yeven and the sustain electrodes X. After completing the address period $A_{G1}$ and the sustain period $S_{11}$ for the odd numbered line group Yodd, the address period $A_{G2}$ may be provided for the even numbered line group Yeven.

In the address period $A_{G2}$ of the address/sustain combination period $T_1$, the scan pulse, which has the voltage of VscL, is sequentially applied to select the scan electrodes of the even numbered line group Yeven while biasing the scan electrodes of the odd numbered line group Yodd and the unselected scan electrodes of the even numbered line group Yeven at the voltage of VscH. As noted above, an address voltage is applied to the address electrodes so as to address (i.e. select, turn-on) desired cells among cells defined by the scan electrode line to which the scan pulse is applied.

In the sustain periods $S_{21}$ and $S_{12}$ of the address/sustain combination period $T_1$, the sustain pulse, which alternately has a voltage of Vs or 0V, is applied to the scan electrodes Yodd and Yeven and the sustain electrodes X. Consequently, sustain discharge is generated in the cells of the even numbered line group Yeven that were selected during the address period $A_{G2}$ and the cells of the odd numbered line group Yodd that were selected during the address period $A_{G1}$. That is, in the address/sustain combination period $T_1$, the sustain period $S_{21}$ is provided for the even numbered line group Yeven while the second sustain period $S_{12}$ is simultaneously provided for the odd numbered line group Yodd.

In the common sustain period $T_2$, the sustain pulse is alternately applied to the scan electrodes Yodd and Yeven and the sustain electrodes X so that a common sustain discharge is performed for the scan electrodes Yodd and Yeven.

In the brightness correction period $T_3$, further sustain periods are provided for the even numbered line group Yeven such that the selected cells of the odd numbered line group Yodd and the even numbered line group Yeven may have substantially the same brightness. That is, in the brightness correction period $T_3$, sustain discharge is generated only in the selected cells of the even numbered line group Yeven. Therefore, sustain discharge is not generated in the selected cells of the odd numbered line group Yodd in the brightness correction period $T_3$. To this end, when the sustain pulse, which has the voltage of Vs, is applied to the sustain electrodes X, a voltage of $V_{L2}$, which is between the voltage of Vs and 0V, is applied to the scan electrodes of the odd numbered line group Yodd, and a ground voltage 0V is applied to the scan electrodes of the even numbered line group Yeven. As a result, since the difference of the voltages between the scan electrodes of the odd numbered line group Yodd and the sustain electrodes X does not reach the discharge firing voltage Vf, a discharge is not generated in the cells of the odd numbered line group Yodd, but sustain discharge is generated in the selected cells of the even numbered line group Yeven. Thereafter, 0V is applied to the sustain electrodes X and the voltage of Vs is applied to the scan electrodes of the groups Yodd and Yeven. As a result, since the previous sustain discharge is not generated and the reverse polarity of wall voltage is formed, the sustain discharge is not generated in cells of the odd numbered line group Yodd and is only generated in the even numbered line group Yeven. In this manner, when the number of sustain discharges of the even numbered line group Yeven is restrained to be the same as the number of sustain discharges of the odd numbered line group Yodd generated during the sustain period $S_{11}$ of the address/sustain combination period $T_1$, the cells of the odd numbered line group Yodd have the same brightness as that of the cells of the even numbered line group Yeven.

Accordingly, in the subfield of FIG. 4, 5 discharges are generated for the selected cells of the odd numbered line group Yodd and the even numbered line group Yeven.

However, when the brightness correction period $T_3$ is provided so that the odd numbered line cells may have the same brightness as that of the even numbered line cells, the respective scan integrated circuits (ICs) are designed to be used for the odd numbered lines Yodd and the even numbered lines Yeven. As a result, the voltages VL2 and 0V may be differently applied to the odd numbered lines Yodd and even numbered lines Yeven in the brightness correction period $T_3$.

Accordingly, the plasma display device may have a larger and more complicated driving board due to many scan ICs.

An exemplary embodiment of the present invention that is capable of correcting the brightness for the odd numbered lines Yodd and the even numbered lines Yeven without different scan ICs will be described below with reference to FIG. 5.

Figure 5:
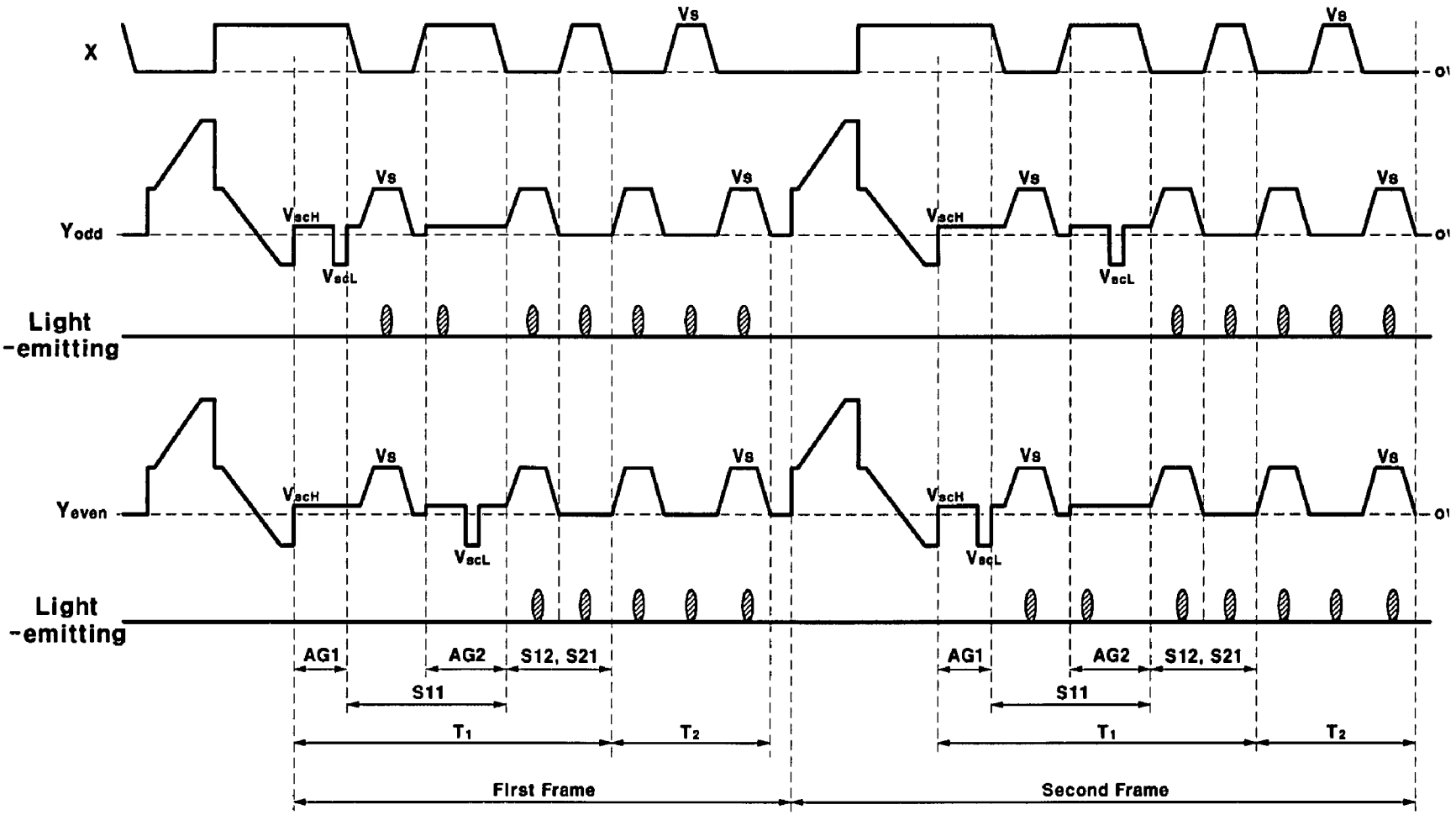
FIG. 5 is a driving waveform diagram of a plasma display device according to a second exemplary embodiment of the present invention.

FIG. 5 is a driving waveform diagram of a plasma display device according to a second exemplary embodiment of the present invention. Particularly, this driving waveform diagram is an example for the first frame and the second frame.

In the first frame, the driving waveform according to the second exemplary embodiment of the present invention is similar to the driving waveform according to the first exemplary embodiment except for the brightness correction period $T_3$. For ease of description, the same parts that are described in the first embodiment of the present invention are omitted here.

Referring to FIG. 5, in the first frame, the driving waveform according to the second exemplary embodiment of the present invention does not have the brightness correction period $T_3$ as shown in the driving waveform according to the first exemplary embodiment of the present invention. Accordingly, when the second sustain discharge $S_{12}$ of the odd numbered line group Yodd and the first sustain discharge S21 of the even numbered line group Yeven ends, the common sustain period $T_2$ is provided for these two groups Yodd and Yeven. In the common sustain period $T_2$, the sustain pulse, which has the voltage of Vs and 0V, is alternately applied to the scan electrodes Yodd and Yeven and the sustain electrodes X. That is, when the sustain pulse having the voltage Vs is applied to the sustain electrodes X, the ground voltage 0V is applied to scan electrodes of the odd and even numbered line groups Yodd and Yeven. As a result, sustain discharge is generated in selected cells of both of the odd and even numbered line groups Yodd and Yeven. Thereafter, the ground voltage 0V is applied to the sustain electrodes X, and the sustain discharge pulse, having the voltage of Vs, is applied to the scan electrodes of the odd and even numbered line groups Yodd and Yeven. Likewise, sustain discharge is generated in selected cells of both of the odd and even numbered line groups Yodd and Yeven. Accordingly, in the first frame of FIG. 5, since the sustain discharge is generated in both of the odd and even numbered line groups Yodd and Yeven during the common sustain period $T_2$, a total of 7 sustain discharges are generated in the selected cells of the odd numbered line group Yodd, and a total of 5 sustain discharges are generated in the selected cells of the even numbered line group Yeven.

Next, compared with the first frame, the second frame applies a reversed address operation order for the odd numbered line group Yodd and the even numbered line group Yeven. For example, in the first frame, the address period $A_{G1}$ and sustain period $S_{11}$ are provided first for the odd numbered line group Yodd, and then the address period $A_{G2}$ and sustain period $S_{21}$ are provided for the even numbered line group Yeven. But in the second frame, the address period $A_{G1}$ and sustain period $S_{11}$ are provided first for the even numbered line group Yeven, and then the address period $A_{G2}$ and sustain period $S_{21}$ are provided for the odd numbered line group Yodd. In the second frame, a total of 5 sustain discharges are generated in the selected cells of the odd numbered line group Yodd, and a total of 7 sustain discharges are generated in the selected cells of the even numbered line group Yeven.

As described above, when an address operation order of the odd numbered line group Yodd and even numbered line group Yeven is reversed between the first frame and the second frame, the difference between the number of sustain discharges of the odd numbered line group Yodd and the even numbered line group Yeven may be corrected. That is, in the first frame, a total of 7 sustain discharges are generated in the selected cells of the odd numbered line group Yodd, and a total of 5 sustain discharges are generated in the selected cells of the even numbered line group Yeven, while in the second frame, a total of 5 sustain discharges are generated in the selected cells of the odd numbered line group Yodd, and a total of 7 sustain discharges are generated in the selected cells of the even numbered line group Yeven.

Therefore, at the end of the first and second frames, 12 sustain discharges will have been generated in the selected cells of the odd numbered line group Yodd and the even numbered line group Yeven.

As such, according to the second exemplary embodiment of the present invention, the number of sustain discharges may be controlled in the display panel cells divided into the odd numbered line group Yodd and the even numbered line group Yeven. Accordingly, the imbalance of the brightness, which is caused by different numbers of sustain discharges between the respective groups, may be avoided.

In this embodiment, the scan electrodes Y are divided into odd and even numbered line groups Yodd and Yeven. However, the present invention is not limited thereto, because the scan electrodes Y may be divided in various ways. Also, even when the scan electrodes Y are divided into two or more groups, an operation order of the respective groups may be reversed for the respective frame during the address/sustain combination period $T_1$. Thus, the same effect may be achieved as in the present embodiment.

FIG. 6 is a block diagram showing a driving method for a PDP according to a third exemplary embodiment of the present invention.

Referring to FIG. 6, when the address operation order of an even numbered line group Yeven and an odd numbered line group Yodd varies for the respective subfields, the difference in the number of sustain discharges between the even numbered line group Yeven and the odd numbered line group Yodd may be corrected.

For example, when the first frame has eight subfields, in the first subfield SF1, the address operation is performed for the even numbered line group Yeven before it is performed for the odd numbered line group Yodd. Next, in the second subfield SF2, the address operation is performed for the odd numbered line group Yodd before it is performed for the even numbered line group Yeven. As such, from the third subfield SF3 to the eighth subfield SF8, the address operation is alternately performed in order of the even numbered line group Yeven/odd numbered line group Yodd or in order of the odd numbered line group Yodd/even numbered line group Yeven. For example, since the address operation is performed first for the even numbered line group Yeven in the first subfield SF1 of the first frame of FIG. 6, in the second subfield SF2 to the eighth subfield SF8, the address operation is firstly performed in the order of odd numbered line group Yodd/even numbered line group Yeven/odd numbered line group Yodd/even numbered line group Yeven/odd numbered line group Yodd/even numbered line group Yeven/odd numbered line group Yodd.

The second frame is consecutive with the first frame. When the second frame is compared to the first frame, the address operation is reversed. For example, in the first subfield SF1 of the second frame, the address operation is performed for the odd numbered line group Yodd before it is performed for the even numbered line group Yeven. From the second subfield SF2 to the eighth subfield SF8, the address operation order alternates for the respective subfields. As shown in FIG. 6, when in the first subfield, the address operation is performed first for the even numbered line group Yeven, and in the second subfield consecutive with the first subfield, the address operation is performed first for the odd numbered line group Yodd.

Figure 7:
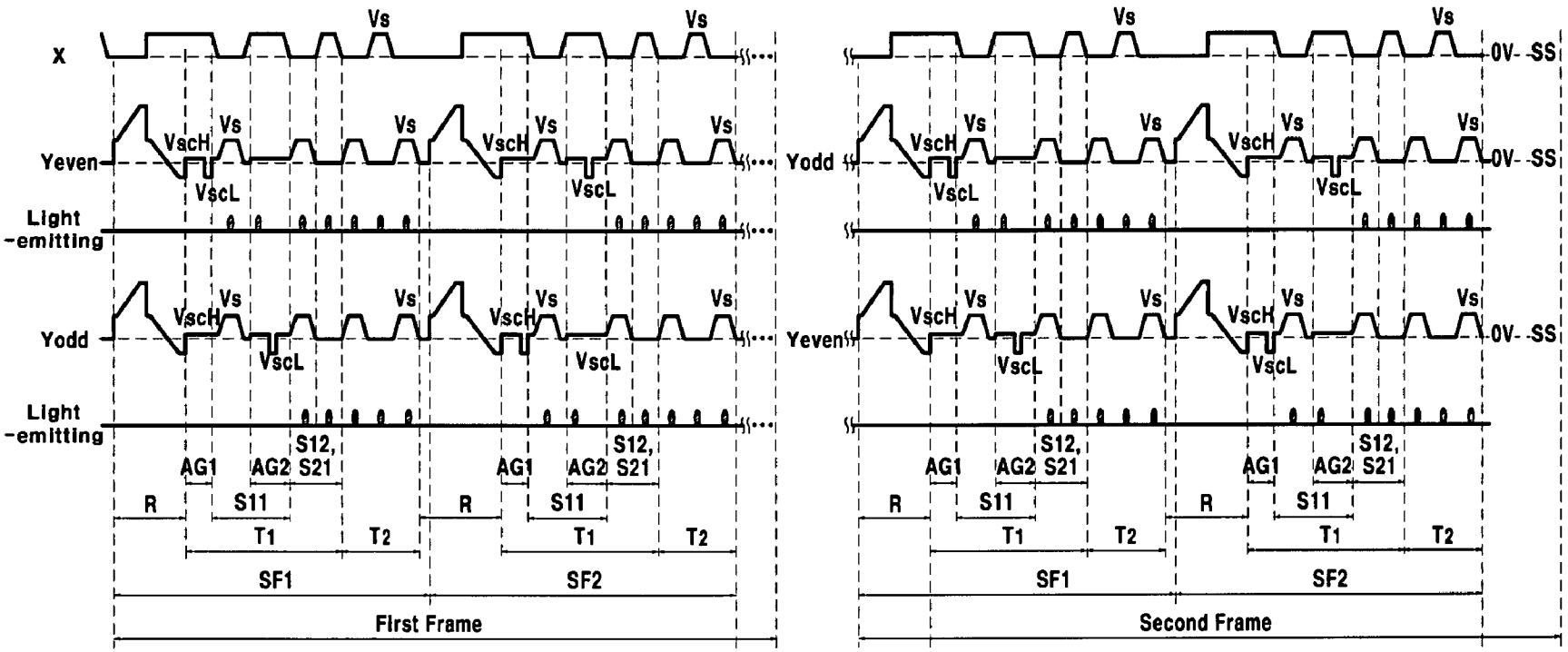
FIG. 7 is a driving waveform diagram of a plasma display device according to the third exemplary embodiment of the present invention.

FIG. 7 is a driving waveform diagram of a plasma display device according to the third exemplary embodiment of the present invention. Particularly, this driving waveform diagram is an example of the first frame and the second frame.

Referring to FIG. 7, at the first frame of the driving waveform, the address operation order of the even numbered line group Yeven and the odd numbered line group Yodd varies for the respective subfields as described in FIG. 6. Also, at the next frame, that is, the second frame, the address operation order is reversed as compared to the address operation order of the respective group of the first frame. For example, when the first subfield of the second frame is compared to the first subfield of the first frame, the address operation is performed for the odd numbered line group Yodd and then is performed for the even numbered line group Yeven.

As described above, when the address operation order of one even numbered line group Yeven and odd numbered line group Yodd varies for the respective subfields of the first and second frames, the difference between the number of sustain discharges of the even numbered line group Yeven and the odd numbered line group Yodd may be corrected.

As described above, according to an exemplary embodiment of the present invention, the PDP may be driven by cells divided into a plurality of groups without a further driving circuit.

Also, when expressing a grayscale in cells divided into a plurality of groups without a further driving circuit in a frame-subfield manner, idle time between the address period and the sustain period may be minimized to smoothly perform the sustain discharge.

Also, the same scan IC design may be used for the respective groups. Accordingly, the IC board may be more easily fabricated because of its small size and simple pattern.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method for driving a plasma display panel having a plurality of first electrodes and a plurality of second electrodes, and a plurality of third electrodes formed crossing the first electrodes and the second electrodes, wherein a discharge cell is defined by a first electrode, a second electrode, and a third electrode, and a frame is divided into a plurality of subfields, the plurality of first electrodes being divided into a plurality of groups, a subfield including a plurality of sustain periods and a plurality of address periods corresponding to the respective groups, the method comprising:

in a first subfield of a first frame, selecting turn-on discharge cells among discharge cells of a first group of first electrodes by performing an address operation for the first group, and performing a sustain discharge for selected discharge cells; and after performing the sustain discharge for the selected discharge cells, selecting turn-on discharge cells among discharge cells of a second group of first electrodes by performing an address operation for the second group, and performing a sustain discharge for selected discharge cells; and in a first subfield of a second frame, selecting turn-on discharge cells among discharge cells of the second group by performing an address operation for the second group, and performing a sustain discharge for selected discharge cells; and after performing the sustain discharge for the selected discharge cells, selecting turn-on discharge cells among discharge cells of the first group by performing an address operation for the first group, and performing a sustain discharge for selected discharge cells.

2. The method of claim 1, further comprising, in a second subfield of the first frame:

selecting turn-on discharge cells among discharge cells of the second group by performing an address operation for the second group, and performing a sustain discharge for selected discharge cells; and selecting turn-on discharge cells among discharge cells of the first group by performing an address operation for the first group, and performing a sustain discharge for selected discharge cells.

3. The method of claim 2, further comprising, in a second subfield of the second frame:

selecting turn-on discharge cells among discharge cells of the first group by performing an address operation for the first group, and performing a sustain discharge for selected discharge cells; and selecting turn-on discharge cells among discharge cells of the second group by performing an address operation for the second group, and performing a sustain discharge for selected discharge cells.

4. The method of claim 1, wherein the second frame is consecutive with the first frame.

5. The method of claim 1, wherein at least one sustain period of the plurality of sustain periods is provided between two adjacent address periods of the plurality of address periods.

6. The method of claim 1, wherein a weight value allocated to the first subfield of the first frame is the same as a weight value allocated to the first subfield of the second frame.

7. The method of claim 3, wherein a weight value allocated to the first subfield of the first frame is the same as a weight value allocated to the first subfield of the second frame.

8. The method of claim 3, wherein the second subfield of the first frame is consecutive with the first subfield of the first frame, and the second subfield of the second frame is consecutive with the first subfield of the second frame.

9. The method of claim 8, wherein the first subfield of the first frame is an initial subfield of the first frame, and the first subfield of the second frame is an initial subfield of the second frame.

10. The method of claim 1, wherein the plurality of first electrodes is divided into two groups.

11. The method of claim 1, wherein, performing the sustain discharge for selected discharge cells comprises sustain discharging discharge cells selected in a current addressing operation as well as discharge cells selected in a previous addressing operation within the same subfield.

12. A plasma display device, comprising:

a plasma display panel having a plurality of first electrodes and a plurality of second electrodes, and a plurality of third electrodes formed crossing the first electrodes and the second electrodes, a discharge cell being defined by a first electrode, a second electrode, and a third electrode; and a driver for applying a driving signal to the first electrodes, the first electrodes being divided into a plurality of groups, wherein the driver, in a first subfield of a first frame including a plurality of sustain periods and a plurality of address periods corresponding to the respective groups of first electrodes, selects turn-on discharge cells among discharge cells of a first group of first electrodes by performing an address operation for the first group, and performs a sustain discharge for selected discharge cells; and after performing the sustain discharge for the selected discharge cells, selects turn-on discharge cells among discharge cells of a second group of first electrodes by performing an address operation for the second group, and performs a sustain discharge for selected discharge cells; and and in a first subfield of a second frame including a plurality of sustain periods and a plurality of address periods corresponding to the respective groups of first electrodes, selects turn-on discharge cells among discharge cells of the second group by performing an address operation for the second group, and performs a sustain discharge for selected discharge cells; and after performing the sustain discharge for the selected discharge cells, selects turn-on discharge cells among discharge cells of the first group by performing an address operation for the first group, and performs a sustain discharge for selected discharge cells.

13. The plasma display device of claim 12, wherein in a second subfield of the first frame, the driver:

selects turn-on discharge cells among discharge cells of the second group by performing an address operation for the second group, and performs a sustain discharge for selected discharge cells; and selects turn-on discharge cells among discharge cells of the first group by performing an address operation for the first group, and performs a sustain discharge for selected discharge cells.

14. The plasma display device of claim 12, wherein in a second subfield of the second frame, the driver:

selects turn-on discharge cells among discharge cells of the first group by performing an address operation for the first group, and performs a sustain discharge for selected discharge cells; and selects turn-on discharge cells among discharge cells of the second group by performing an address operation for the second group, and performs a sustain discharge for selected discharge cells.

15. The plasma display device of claim 12, wherein the second frame is consecutive with the first frame.

16. The plasma display device of claim 12, wherein at least one sustain period of the plurality of sustain periods is provided between two adjacent address periods of the plurality of address periods.

17. The plasma display device of claim 12, wherein a weight value allocated to the first subfield of the first frame is the same as a weight value allocated to the first subfield of the second frame.

18. The plasma display device of claim 14, wherein a weight value allocated to the first subfield of the first frame is the same as a weight value allocated to the first subfield of the second frame.

19. The plasma display device of claim 14, wherein the second subfield of the first frame is consecutive with the first subfield of the first frame, and the second subfield of the second frame is consecutive with the first subfield of the second frame.

20. The plasma display device of claim 12, wherein the plurality of first electrodes is divided into two groups.

21. A method for driving a plasma display panel having a plurality of first electrodes and a plurality of second electrodes, and a plurality of third electrodes formed crossing the first electrodes and the second electrodes, wherein a discharge cell is defined by a first electrode, a second electrode, and a third electrode, and a frame is divided into a plurality of subfields, the method comprising:

dividing the plurality of first electrodes into a plurality of groups;

in a first subfield of a first frame, sequentially addressing and sustain discharging discharge cells of groups of first electrodes on a group by group basis from a first group to a last group; and in a first subfield of a second frame, sequentially addressing and sustain discharging discharge cells of the groups of first electrodes on the group by group basis from the last group to the first group.

22. The method of claim 21, further comprising, in a second subfield of the first frame, sequentially addressing and sustain discharging discharge cells of the groups of first electrodes on the group by group basis from the last group to the first group; and in a second subfield of the second frame, sequentially addressing and sustain discharging discharge cells of groups of first electrodes on the group by group basis from the first group to the last group.

23. The method of claim 21, wherein the second frame is consecutive with the first frame.

24. The method of claim 22, wherein a weight value allocated to the first subfield of the first frame is the same as a weight value allocated to the first subfield of the second frame.

25. The method of claim 23, wherein the second subfield of the first frame is consecutive with the first subfield of the first frame, and the second subfield of the second frame is consecutive with the first subfield of the second frame.

26. The method of claim 25, wherein the first subfield of the first frame is an initial subfield of the first frame, and the first subfield of the second frame is an initial subfield of the second frame.

27. The method of claim 21, wherein the plurality of first electrodes is divided into two groups.

* * * * *

UNITED STATES PATENT AND TRADEMARK OFFICE

CERTIFICATE OF CORRECTION

PATENT NO. : 7,612,741 B2
APPLICATION NO. : 11/272088
DATED : November 3, 2009
INVENTOR(S) : Dae-Hwan Kim It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1024 days.

Signed and Sealed this

Nineteenth Day of October, 2010

David J. Kappos

David J. Kappos
*Director of the United States Patent and Trademark Office*